US010180230B2

(12) United States Patent
Tezuka et al.

(10) Patent No.: US 10,180,230 B2
(45) Date of Patent: Jan. 15, 2019

(54) VEHICLE LAMP

(71) Applicant: NITTO DENKO CORPORATION, Ibaraki-shi, Osaka (JP)

(72) Inventors: Teppei Tezuka, Osaka (JP); Youzou Yano, Osaka (JP); Kazuhiro Omura, Osaka (JP)

(73) Assignee: NITTO DENKO CORPORATION, Osaka (JP)

( * ) Notice: Subject to any disclaimer, the term of this patent is extended or adjusted under 35 U.S.C. 154(b) by 172 days.

(21) Appl. No.: 15/101,328

(22) PCT Filed: Nov. 12, 2014

(86) PCT No.: PCT/JP2014/005691
§ 371 (c)(1),
(2) Date: Jun. 2, 2016

(87) PCT Pub. No.: WO2015/083324
PCT Pub. Date: Jun. 11, 2015

(65) Prior Publication Data

US 2016/0369971 A1 Dec. 22, 2016

(30) Foreign Application Priority Data

Dec. 4, 2013 (JP) ..... 2013-251543

(51) Int. Cl.
*F21S 8/10* (2006.01)
*F21V 31/03* (2006.01)
(Continued)

(52) U.S. Cl.
CPC ..... *F21S 48/335* (2013.01); *F21S 45/33* (2018.01); *F21V 31/03* (2013.01); *F21S 45/30* (2018.01)

(58) Field of Classification Search
CPC ..... F21S 45/30; F21S 45/33; F21S 45/37
See application file for complete search history.

(56) References Cited

U.S. PATENT DOCUMENTS 4,937,710 A 6/1990 Hurley et al.
5,003,446 A * 3/1991 Nagengast ..... F21S 45/33 362/294
(Continued)

FOREIGN PATENT DOCUMENTS

DE 3328788 A1 2/1985
DE 102004022836 A1 12/2005
(Continued)

OTHER PUBLICATIONS

English Machine Translation of JP 2013218853 provided by ESPACENET.*
(Continued)

*Primary Examiner* — Zheng Song
(74) *Attorney, Agent, or Firm* — Hamre, Schumann, Mueller & Larson, P.C.

(57) ABSTRACT

A lamp chamber (110) includes: a first lamp chamber (110A) located in a forward direction from a first reference plane (P1) and inwardly of a second reference plane (P2) in a width direction of a vehicle; and a second lamp chamber (110B) located in a rearward direction from the first reference plane (P1) and outwardly of the second reference plane (P2) in the width direction of the vehicle. A headlamp (101) includes: a first vent member (105) attached to a first opening portion (102A) provided in a region of a housing (102) facing the first lamp chamber (110A); and a second vent member (106) attached to a second opening portion (102B) provided in a region of the housing (102) facing the second lamp chamber (110B). The vent members (105, 106) each include a waterproof air-permeable body. The air permeability value of the first vent member (105) is higher than the air permeability value of the second vent member (106).

4 Claims, 8 Drawing Sheets

(51) Int. Cl.
*F21S 45/33* (2018.01)
*F21S 45/30* (2018.01)

(56) References Cited

U.S. PATENT DOCUMENTS

| | | | | |
|---|---|---|---|---|
| 5,010,453 | A | 4/1991 | Ketterman | |
| 6,071,000 | A * | 6/2000 | Rapp | F21S 48/332 362/362 |
| 6,164,806 | A * | 12/2000 | Schmickl | F21S 48/335 362/294 |
| 6,210,014 | B1 | 4/2001 | Kubizne et al. | |
| 6,948,839 | B2 | 9/2005 | Ishizaki | |
| 2009/0268475 | A1 * | 10/2009 | Ball | F21V 29/83 362/373 |

FOREIGN PATENT DOCUMENTS

| | | |
|---|---|---|
| FR | 2 616 206 | 12/1988 |
| JP | H0550603 U | 7/1993 |
| JP | 7-057513 | 3/1995 |
| JP | 2013-057513 | 3/1995 |
| JP | 2003-346548 | 12/2003 |
| JP | 2006-324260 | 11/2006 |

OTHER PUBLICATIONS

Extended European Search Report issued for corresponding European Patent Application No. 14868645.4, dated Dec. 1, 2017, 8 pages.

* cited by examiner

VEHICLE LAMP

TECHNICAL FIELD

The present invention relates to vehicle lamps, specifically to vehicle lamps such as headlamps adapted to be mounted at the front ends of vehicles, and more specifically to vehicle lamps suitable for rapid elimination of water condensation that may occur inside the lamps.

BACKGROUND ART

Vehicle lamps are used as lighting devices for illuminating the outside of vehicles to improve drivers' visibility or as display devices for transmitting various signals to the outside. Examples of vehicle lamps serving as lighting devices include headlamps and fog lamps having forward illumination light sources. In some cases, a vehicle lamp housing is provided with a vent member for providing an air passage to eliminate a pressure difference between the inside and outside of a lamp chamber. The vent member prevents entry of water and foreign matters such as dust into the lamp chamber while eliminating the pressure difference. A member including a waterproof air-permeable membrane is usually used as such a vent member.

For example, Patent Literature 1 discloses a headlamp shown in FIG. 8. A headlamp 401 includes a housing 402 and a light-transmitting member 403 attached to the front of the housing 402. A forward illumination light source 404 is disposed in a lamp chamber 406 enclosed by the housing 402 and the light-transmitting member 403. The housing 402 has opening portions 402A and 402B, and a microporous, air-permeable member as a vent member 405B is disposed over the opening portion 402B. A member 405A disposed over the opening portion 402A is a water-vapor-permeable but air-impermeable member for reducing condensation.

Water condensation is likely to occur to form water droplets (dew) on the inner surface of the light-transmitting member 403 because it is exposed directly to the outside air and thus is easily cooled. When the light source 404 is turned on, with the water droplets being formed on the inner surface of the light-transmitting member 403, air in the lamp chamber 406 expands as the temperature of the light-transmitting member 403 increases. Thus, a pressure difference is created between the inside and outside of the lamp chamber 406, but this pressure difference is eliminated by the air-permeable vent member 405B. In addition, water vapor produced by evaporation of the water droplets is released not only through the vent member 405B but also through the member 405A serving as a condensation reducing member. The member 405A is not a "vent member" because it is air impermeable and thus does not help to eliminate a pressure difference, but it promotes elimination of condensation.

CITATION LIST

Patent Literature

Patent Literature 1: JP 2006-324260 A

SUMMARY OF INVENTION

Technical Problem

New designs have recently been developed for light-transmitting members of headlamps to improve the aesthetic appearance of vehicles. For example, light-transmitting members extending forward and rearward from forward illumination light sources have been proposed. However, the present inventors' studies indicate that it is likely to take a longer time for such a headlamp to eliminate condensation on the inner surface of the light-transmitting member.

If water droplets are present on the inner surface of the light-transmitting member for a long time, even if the water droplets are present in a region through which only a very small fraction of light emitted from the forward illumination light source is transmitted, such prolonged presence of the water droplets causes poor appearance of the headlamp, which may give the user an impression as if the performance of the headlamp decreased. In the case of a headlamp including not only a forward illumination light source but also a position lamp light source, etc. disposed in a space located in the rearward direction of the vehicle from the forward illumination light source, the visibility of signals from these light sources may decrease due to such water droplets.

Under these circumstances, it is an object of the present invention to provide a vehicle lamp including a forward illumination light source and a light-transmitting member extending forward and rearward from the forward illumination light source and capable of eliminating condensation on the inner surface of the light-transmitting member in a short time.

Solution to Problem

The present invention provides a vehicle lamp adapted to be mounted at a lateral end of a front end portion of a vehicle, including: a housing; a light-transmitting member attached to the housing so as to form a lamp chamber; a forward illumination light source disposed in the lamp chamber and configured to emit light in a forward direction of the vehicle through the light-transmitting member; and a first vent member and a second vent member. In this vehicle lamp, the lamp chamber includes a first lamp chamber and a second lamp chamber, the first lamp chamber being located in the forward direction of the vehicle from a first reference plane and inwardly of a second reference plane in a width direction of the vehicle and the second lamp chamber being located in a rearward direction of the vehicle from the first reference plane and outwardly of the second reference plane in the width direction of the vehicle, when a plane perpendicular to an optical axis of the forward illumination light source and passing a forward end of the forward illumination light source is defined as the first reference plane and a plane including the optical axis and extending in a vertical direction is defined as the second reference plane. The light-transmitting member includes a front part and a rear part, the front part being located in the forward direction from the first reference plane and facing the first lamp chamber, the rear part being located in the rearward direction from the first reference plane and facing the second lamp chamber. The first vent member is attached to a first opening portion provided in a region of the housing facing the first lamp chamber. The second vent member is attached to a second opening portion provided in a region of the housing facing the second lamp chamber. The first vent member and the second vent member each include a waterproof air-permeable body. An air permeability value of the first vent member is higher than an air permeability value of the second vent member when the air permeability value of each of the first and second vent members is determined by measuring a volume of air permeated per unit area of the waterproof air-permeable body by Method A (Frazier method) for air permeability measurement according to Japanese Industrial Standards (JIS) L 1096 and then multiplying the measured volume of air by an air-permeable area of the waterproof air-permeable body.

Advantageous Effects of Invention

According to the present invention, it is possible to provide a vehicle lamp capable of eliminating condensation on the inner surface of a portion of a light-transmitting member extending rearward from a forward illumination light source in a short time after the forward illumination light source is turned on.

DESCRIPTION OF EMBODIMENTS

Hereinafter, embodiments of the present invention will be described with reference to the accompanying drawings. The following description is only illustrative of embodiments of the present invention and is not intended to limit the present invention to this description.

Figure 1:
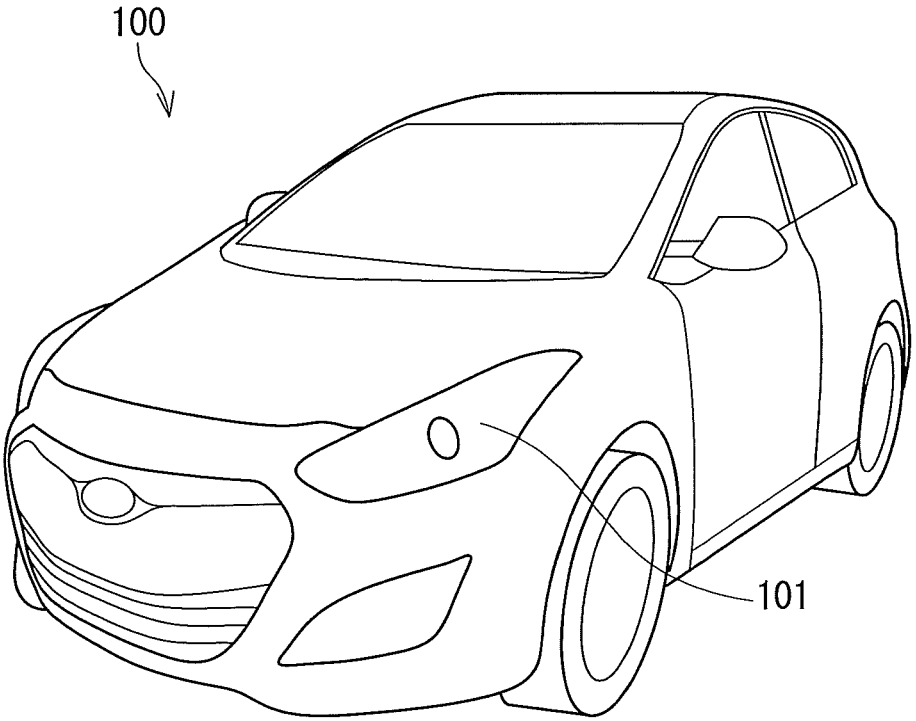
FIG. 1 is a perspective view of a vehicle provided with a vehicle lamp according to an embodiment of the present invention.

As shown in FIG. 1, headlamps 101 as vehicle lamps are usually mounted in the front end portion of a vehicle 100 as a passenger car. The headlamps 101 are each located at a lateral end of the front end portion of the vehicle 100. Each of the headlamps 101 often includes two or more light sources such as a high beam light source (for forward illumination for a driver), a low beam light source (for forward illumination for vehicles ahead), and a position lamp (or side marker lamp) light source, but for the sake of simplicity of illustration and description, only the low beam light source is shown in the figures below as a rule.

Figure 2A:
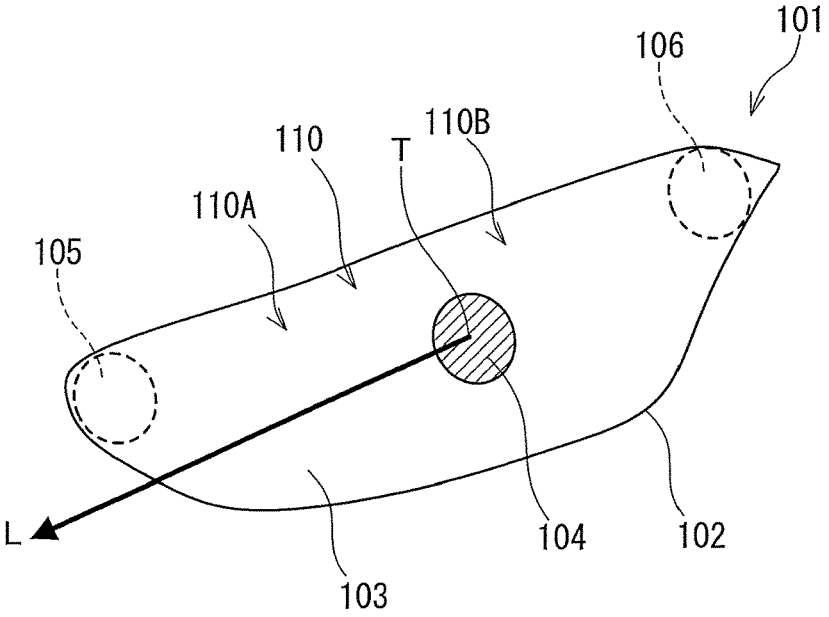
FIG. 2A is a schematic perspective view of the vehicle lamp shown in FIG. 1.
Figure 3:
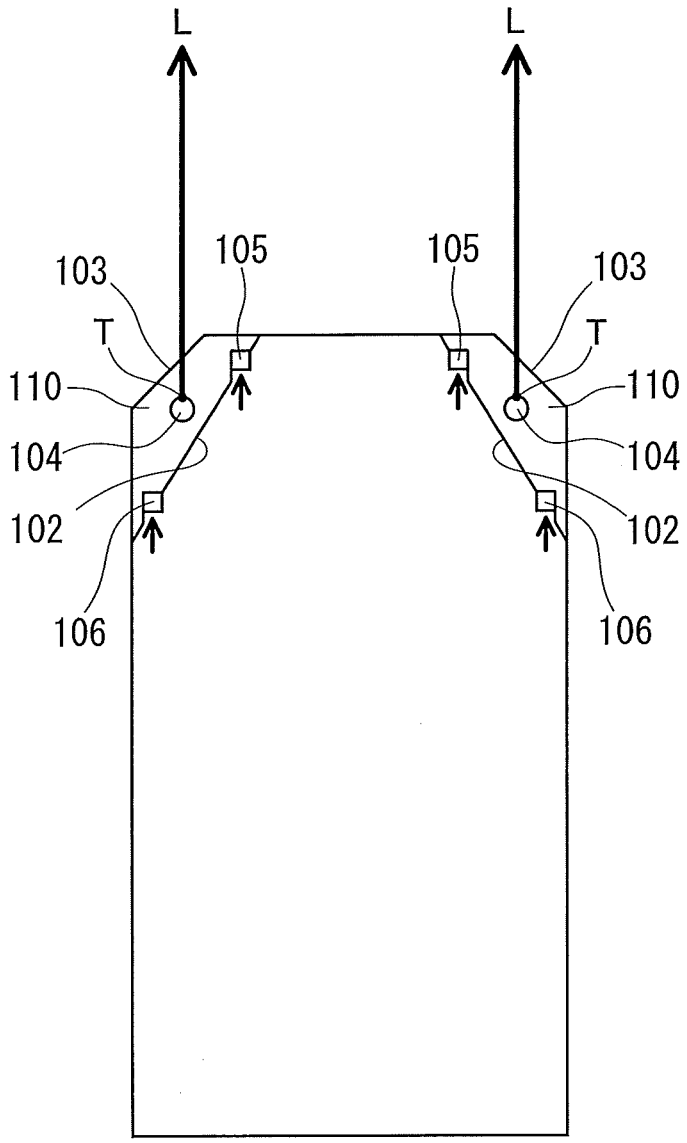
FIG. 3 is a schematic plan view of the vehicle provided with the vehicle lamps shown in FIG. 1.
Figure 4A:
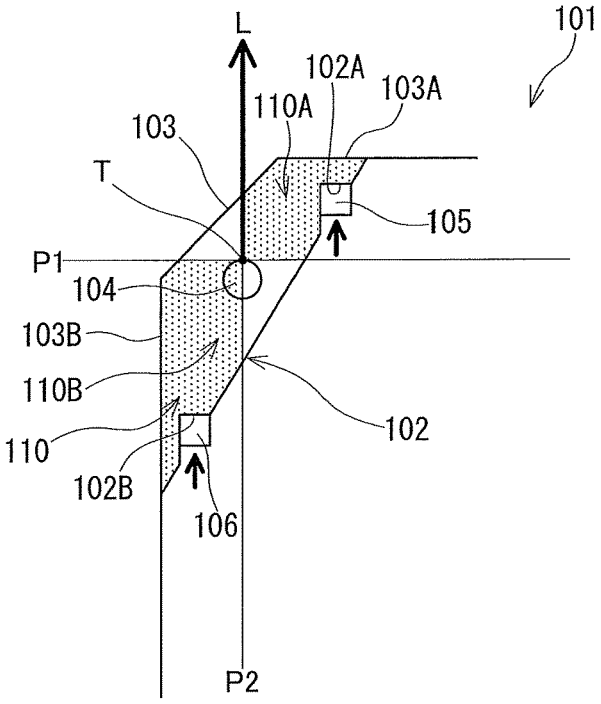
FIG. 4A is a schematic plan view of the vehicle lamp shown in FIG. 1.

As shown in FIG. 2A and FIG. 3, the headlamp 101 includes a housing 102, a light-transmitting member 103 attached to the housing 102 so as to form a lamp chamber 110, and a forward illumination light source 104 disposed in the lamp chamber 110 and configured to emit light in the forward direction of the vehicle 100 through the light-transmitting member 103. As shown in FIG. 4A, in order to describe each region of the space in the lamp chamber 110, a plane perpendicular to the optical axis L of the forward illumination light source 104 and passing the forward end T of the forward illumination light source 104 is defined as a first reference plane P1, and a plane including the optical axis L and extending in the vertical direction is defined as a second reference plane P2. Based on these definitions, the lamp chamber 110 includes at least a first lamp chamber 110A and a second lamp chamber 110B. The first lamp chamber 110A is located in the forward direction of the vehicle 100 from the first reference plane P1 (on the upper side in FIG. 4A) and inwardly of the second reference plane P2 in the width direction of the vehicle 100 (on the right side in FIG. 4A), and the second lamp chamber 110B is located in the rearward direction of the vehicle 100 from the first reference plane P1 (on the lower side in FIG. 4A) and outwardly of the second reference plane P2 in the width direction of the vehicle 100 (on the left side in FIG. 4A).

The light-transmitting member 103 includes a front part 103A and a rear part 103B. The front part 103A is located in the forward direction of the vehicle 100 from the first reference plane P1 and faces the first lamp chamber 110A, while the rear part 103B is located in the rearward direction of the vehicle 100 from the first reference plane P1 and faces the second lamp chamber 110B. The light-transmitting member 103 extends in both forward and rearward directions from the first reference plane P1 while intersecting the first reference plane P1 and the second reference plane P2.

The headlamp 101 includes a first vent member 105 and a second vent member 106. The first vent member 105 is attached to a first opening portion 102A provided in a region of the housing 102 facing the first lamp chamber 110A, while the second vent member 106 is attached to a second opening portion 102B provided in a region of the housing 102 facing the second lamp chamber 110B. The first vent member 105 and the second vent member 106 each include a waterproof air-permeable body. The waterproof air-permeable body is typically a waterproof air-permeable membrane, but it is not limited to a waterproof air-permeable membrane. It may be a porous structure such as a porous resin molded body as long as it has both waterproofness and air permeability. In an embodiment shown herein, the first vent member 105 allows the first lamp chamber 110A to communicate with the outside of the lamp chamber (typically with an engine compartment) through the waterproof air-permeable membrane in the member 105, while the second vent member 106 allows the second lamp chamber 110B to communicate with the outside of the lamp chamber through the waterproof air-permeable membrane in the member 106.

Taking into consideration the possibility of reduction of the air permeability of a vent member for reasons such as mud splash, it is desirable to provide two or more vent members in the housing. It is particularly desirable to provide two or more vent members in a larger-size headlamp in order to rapidly eliminate a pressure difference between the inside and outside of the lamp chamber. However, it is necessary not only to provide such vent members in a limited space in the housing 102 but also to mount the forward illumination light source 104, etc. in the center of the housing 102. Therefore, when two or more vent members should be provided, it is appropriate to provide the vent members respectively in regions facing the first lamp chamber 110A and the second lamp chamber 110B of the housing 102.

The air permeability value of the first vent member 105 is higher than the air permeability value of the second vent member 106. Here, the air permeability value of the vent member is calculated by measuring the volume of air permeated per unit area of the waterproof air-permeable membrane by Method A (Frazier method) for air permeability measurement according to JIS L 1096 and then multiplying the measured volume of air by the air-permeable area of the waterproof air-permeable membrane. The air-permeable area of the waterproof air-permeable membrane means the area of a region of the waterproof air-permeable membrane through which air can pass in its cross-sectional direction. It should be noted that a member not having a positive air permeability value, that is, a member through which air as a gas used in the Frazier method cannot pass, is not treated as a "vent member" in this description. The first vent member 105 and the second vent member 106 are both "vent members", and their air permeability values are positive values.

When the light-transmitting member 103 is cooled by the outside air with the lamp chamber 110 containing humid air, condensation occurs to form water droplets on the inner surface of the light-transmitting member 103. When the forward illumination light source 104 is turned on in this state, the temperature of the light-transmitting member 103 begins to rise. With this temperature rise, water droplets evaporate into water vapor and thus condensation is gradually eliminated. In this case, the light from the forward illumination light source 104 warms the front part 103A of the light-transmitting member 103 before it warms the rear part 103B thereof. Therefore, water vapor is produced by evaporation of water droplets in the first lamp chamber 110A before it is produced in the second lamp chamber 110B. As the temperature rises, the pressure in the lamp chamber 110 increases and thus an air flow is created therein. The water vapor produced in the first lamp chamber 110A is carried by the air flow and released to the outside through an air passage to the outside, specifically through the first vent member 105 or the second vent member 106.

A portion of the water vapor produced in the first lamp chamber 110A is carried by an air flow toward the second vent member 106 and introduced into the second lamp chamber 110B. In this case, if the temperature of the rear part 103B of the light-transmitting member 103 facing the second lamp chamber 110B is not sufficiently high, a portion of the water vapor introduced into the second lamp chamber 110B condenses again and forms additional water droplets on the rear part 103B. A larger amount of water droplets to be removed from the rear part 103B requires a longer time to eliminate the condensation from the entire inner surface of the light-transmitting member 103.

The present inventors' studies indicate that prolonged elimination of condensation from the inner surface of the light-transmitting member 103 can be avoided by setting the air permeability value of the first vent member 105 higher than that of the second vent member 106 so as to increase the amount of water vapor released through the first vent member 105.

In order to release the water vapor produced in the lamp chamber 110 through the first vent member 105, it is preferable that the ratio of the air permeability value of the first vent member 105 to that of the second vent member 106 be higher. This ratio is preferably at least 2, more preferably at least 3, even more preferably at least 5, particularly preferably at least 10, more particularly preferably at least 50, and optionally at least 80. However, it is necessary in practice to provide the first vent member 105 in a limited space in the housing 102, and therefore it is often the case that in order to achieve a desirable total air permeability value, a fraction of the total air permeability value should be allocated to the second vent member 106. In view of this, the above-mentioned ratio may be, for example, 10000 or less, further 5000 or less, and optionally 3000 or less.

Even a combination of the first vent member 105 and the second vent member 106 having a relatively low total air permeability value can eliminate condensation more rapidly than a combination of the first vent member 105 and the second vent member 106 having a relatively high total air permeability value by an appropriate adjustment of the above-mentioned ratio, which is an unexpected result.

As indicated by arrows in FIG. 4A, the opening portions 102A and 102B are openings in the form of through holes extending through the housing 102 in a direction parallel to the optical axis L, but the direction of the opening portions 102A and 102B is not limited to this direction. The through holes may be provided to extend through the housing 102, for example, in a direction perpendicular to the optical axis L.

The forward illumination light source 104 is a low beam light source, and is, for example, a projector-type high intensity discharge (HID) bulb. The forward illumination light source 104 is disposed in the central region of the front of the housing 102 to protrude forward. The optical axis L of the light emitted from the forward illumination light source 104 is oriented parallel to the longitudinal axis of the vehicle 100. The forward end T of the forward illumination light source 104 is a portion located at the most front end of the bulb unit in the forward direction of the vehicle. The forward illumination light source 104 is not limited to a HID bulb, and it may be an incandescent bulb, a halogen bulb, a light emitting diode (LED) bulb, or the like. The forward illumination light source 104 is not limited to a projector-type bulb, and it may be a reflector-type bulb. The forward end T of the bulb is defined as a portion located at the most front end of the bulb unit in the forward direction of the vehicle, regardless of the type and configuration of the bulb.

The headlamp includes two or more forward illumination light sources in some cases. It is only necessary that, in such a headlamp including two or more forward illumination light sources, at least one of the forward illumination light sources have the first and second vent members having the above-described positional relationship and air permeability relationship. In this case, when the at least one forward illumination light source is turned on, prolonged elimination of condensation is avoided. Needless to say, it is more preferable that all the forward illumination light sources have the first and second vent members having the above-described positional relationship and air permeability relationship. In this case, when any of these forward illumination light sources is turned on, prolonged elimination of condensation is avoided.

Figure 4B:
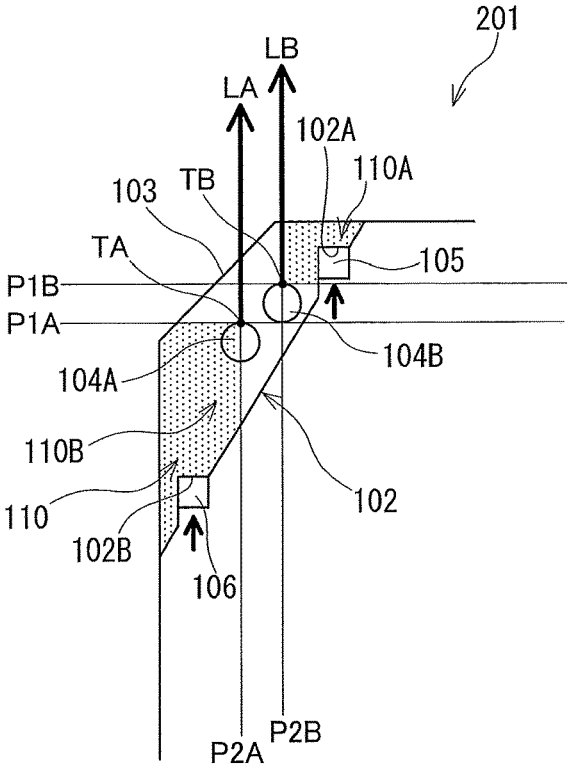
FIG. 4B is a schematic plan view of a vehicle lamp according to a modification.

A headlamp 201 shown in FIG. 4B includes a low beam forward illumination light source 104A (a first forward illumination light source) and a high beam forward illumination light source 104B (a second forward illumination light source). The forward end TB of the second forward illumination light source 104B is located in the forward direction from the forward end TA of the first forward illumination light source 104A (on the upper side in FIG. 4B), while the optical axis LB of the second forward illumination light source 104B is located inwardly of the optical axis LA of the first forward illumination light source 104A in the width direction of the vehicle 100 (on the right side in FIG. 4B). The light source LA and the light source LB are parallel to each other. As shown in FIG. 4B, the first vent member 105 and the second vent member 106 have the above-mentioned relationships with respect to either the forward illumination light source 104A or the forward illumination light source 104B as a reference.

Specifically, when a first reference plane with respect to the first forward illumination light source 104A is defined as a first reference plane P1A and a first reference plane with respect to the second forward illumination light source 104B located in the forward direction of the vehicle from the first reference plane P1A is defined as a first reference plane P1B, the first lamp chamber 110A communicating with the first vent member 105 in the lamp chamber 110 is located in the forward direction of the vehicle from the first reference plane P1B, that is, the first reference plane located in the most forward direction of the vehicle. When a second reference plane with respect to the first forward illumination light source 104A is defined as a second reference plane P2A and a second reference plane with respect to the second forward illumination light source 104B located inwardly of the second reference plane P2A in the width direction of the vehicle is defined as a second reference plane P2B, the first lamp chamber 110A is located inwardly of the second reference plane P2B, that is, the second reference plane located most inwardly in the width direction of the vehicle. When a first reference plane with respect to the first forward illumination light source 104A located in the rearward direction of the vehicle from the first reference plane P1B with respect to the second forward illumination light source 104B is defined as the first reference plane P1A, the second lamp chamber 110B communicating with the second vent member 106 in the lamp chamber 110 is located in the rearward direction of the vehicle from the first reference plane P1A, that is, the first reference plane located in the most rearward direction of the vehicle. When a second reference plane with respect to the first forward illumination light source 104A located outwardly of the second reference plane P2B with respect to the second forward illumination light source 104B in the width direction of the vehicle is defined as the second reference plane P2A, the second lamp chamber 110B is located outwardly of the second reference plane P2A, that is, the second reference plane located most outwardly in the width direction of the vehicle. Also in the headlamp 201, the air permeability value of the first vent member 105 is set higher than that of the second vent member 106.

The headlamp often includes a position lamp light source not shown, in addition to the forward illumination light source 104. However, such a light source included in addition to the forward illumination light source is less effective in eliminating condensation because the energy of emitted light is low.

The housing 102 can be made of a synthetic resin such as polypropylene (PP). Usually, the housing 102 need only be made of an opaque material. The light-transmitting member 103 is a cover member covering the front of the housing 102. The light-transmitting member 103 is made of a light-transmitting, transparent synthetic resin such as polycarbonate (PC). An extension may be placed in the lamp chamber 110 enclosed by the housing 102 and the light-transmitting member 103 so as to partially divide the lamp chamber. The extension is placed in such a manner that the first lamp chamber 110A and the second lamp chamber 110B can communicate with each other.

The first vent member 105 and the second vent member 106 each include a waterproof air-permeable membrane. The waterproof air-permeable membrane is disposed in such a manner that a gas passes the vent member through the membrane. The structure and material of the waterproof air-permeable membrane is not particularly limited as long as it is a membrane that allows passage of a gas and prevents passage of water. However, a porous resin membrane is suitable for the waterproof air-permeable membrane.

A porous fluororesin material or a porous polyolefin material that can be produced by a known stretching or extraction technique can be used as the material of the porous resin membrane. Examples of the fluororesin include polytetrafluoroethylene (PTFE), polychlorotrifluoroethylene, tetrafluoroethylene-hexafluoropropylene copolymer, and tetrafluoroethylene-ethylene copolymer. Examples of monomers in the polyolefin include ethylene, propylene, and 4-methylpentene-1,1-butene. As the polyolefin, a polyolefin obtained by polymerizing these monomers alone or copolymerizing these monomers can be used. A porous nanofiber film material or the like made of polyacrylonitrile, nylon, polylactic acid, or the like can also be used. It is preferable to use, as the porous resin membrane, a stretched porous PTFE membrane because it ensures air permeability even with a small area and is highly capable of blocking entry of foreign substances.

The porous resin membrane may be used in the form of a waterproof air-permeable membrane including a reinforcement layer laminated thereon. Preferably, the reinforcement layer has higher air permeability than the porous resin membrane. The reinforcement layer is, for example, a woven fabric, non-woven fabric, a mesh, a net, a sponge, a foam, a porous material, or the like made of a resin or a metal. The porous resin membrane and the reinforcement layer can be joined together by adhesive lamination, heat lamination, heat welding, ultrasonic welding, or bonding with an adhesive.

It is preferable that the first vent member 105 and the second vent member 106 each include a waterproof air-permeable membrane and in addition, a fixing member for fixing the waterproof air-permeable membrane to the housing. A preferred example of the fixing member is a double-sided adhesive tape. A vent member using a double-sided adhesive tape can be obtained, for example, by joining a waterproof air-permeable membrane having a circular plan view and a double-sided adhesive tape having a ring-like plan view, with their outer edges coinciding with each other.

Figure 6:
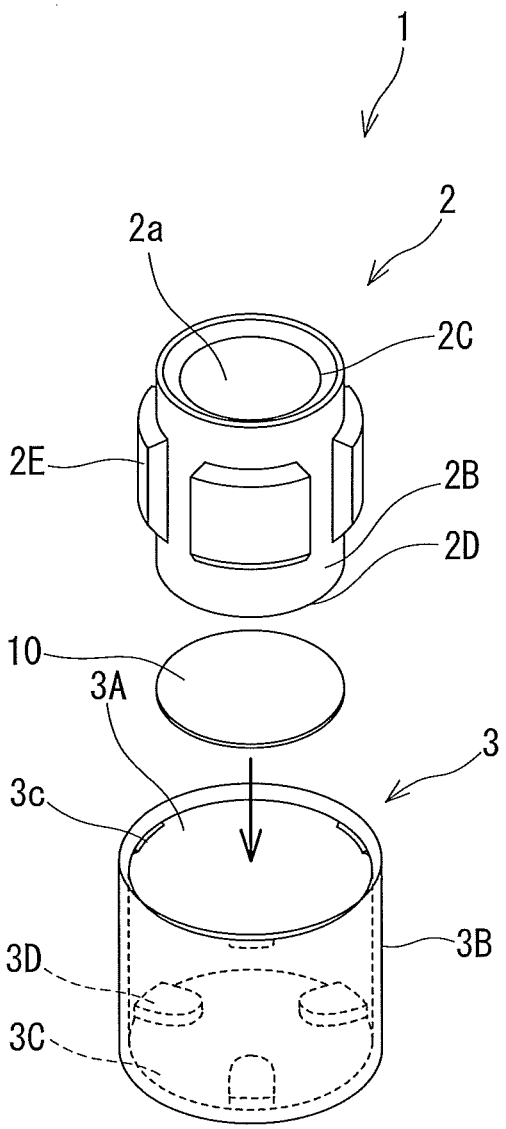
FIG. 6 is an exploded perspective view of an example of a vent member.
Figure 7:
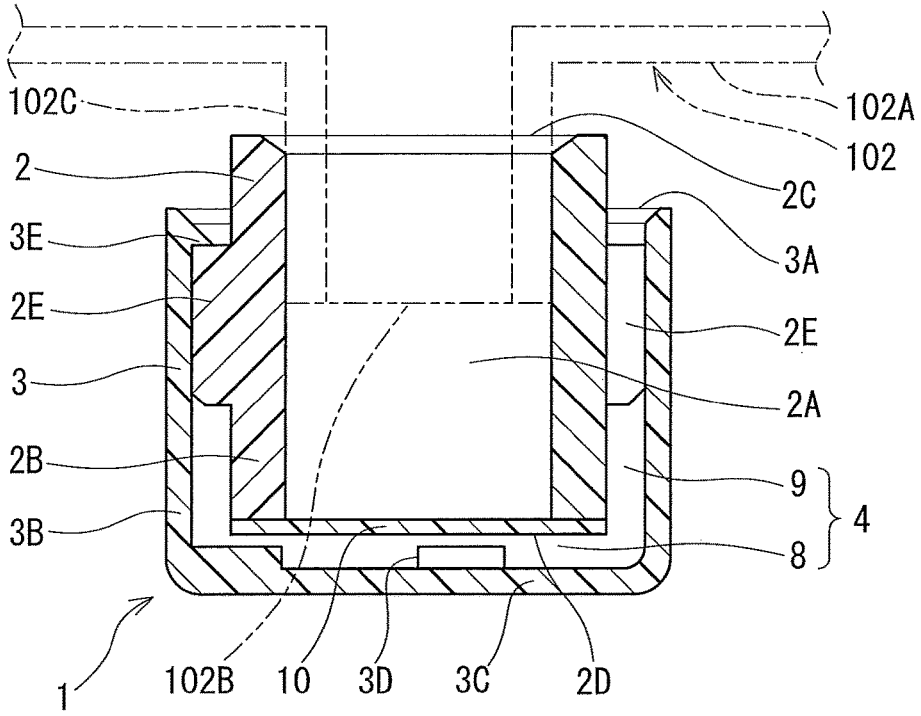
FIG. 7 is an enlarged cross-sectional view of the example of the vent member.
Figure 8:
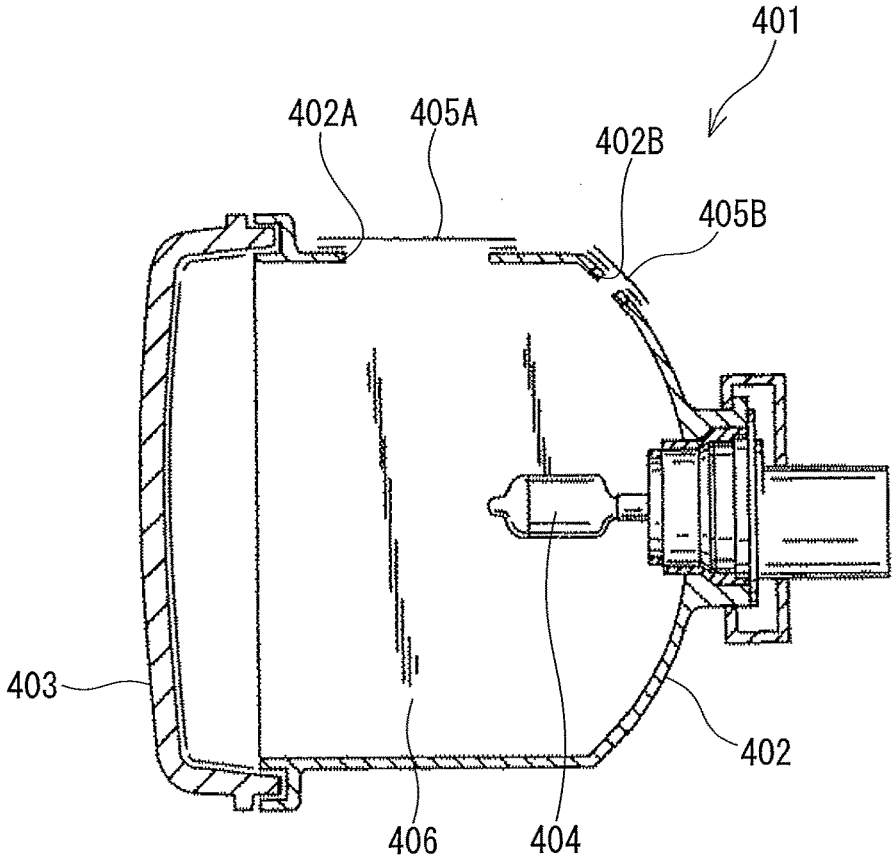
FIG. 8 is a cross-sectional view of a conventional vehicle lamp.

Another preferred example of the fixing member is a resin member having a support surface for supporting the waterproof air-permeable membrane. An example of a vent member 1 including a resin member is shown in FIG. 6 and FIG. 7. The vent member 1 is fitted to a cylindrical neck portion 102C projecting from the outer surface 102A of the housing 102. An opening portion 102B of the housing 102A is formed at the end of the neck portion 102C. The vent member 1 includes an inner member 2 and an outer member 3. The inner member 2 is a cylindrical tubular member adapted to be fitted to the neck portion 102C in such a manner that the inner peripheral surface of the inner member 2 comes into contact with the outer peripheral surface of the neck portion 102C, and has a through hole 2A serving as a part of an air passage communicating between the inside and outside of the housing 102. The through hole 2A has a first opening portion 2C adapted to be fitted to the neck portion 102, and a second opening portion 2D located on the opposite side from the first opening portion 2C. The waterproof air-permeable membrane 10 is supported on the end face of the inner member 2 surrounding the second opening portion 2D so as to cover the second opening portion 2D. The outer member 3 is a bottomed tubular member adapted to be fitted to the outer periphery of the inner member 2, and includes a side wall portion 3B that covers a part of the outer periphery of the inner member 2 and a bottom portion 3C that covers the waterproof air-permeable membrane 10 when fitted to the inner member 2. The outer member 3 is fitted to the inner member 2 so as to form a communication path 8 between the outer member 3 and the waterproof air-permeable membrane 10 and a communication path 9 between the outer member 3 and the outer periphery of the inner member 2. The communication paths 8 and 9 form an air passage 4 communicating with the outside of the housing.

The inner member 2 is, for example, made of an elastomer, more specifically, a thermoplastic or thermosetting elastomer. The inner member 2 has: a cylindrical tube body 2B having the through hole 2A; and four projecting portions 2E arranged at regular intervals in the circumferential direction in a central region of the outer peripheral surface of the tube body 2B and projecting outwardly from the outer peripheral surface. The outer diameter of the inner member 2 defined by the regions where the projecting portions 2E are formed is slightly larger than the inner diameter of the outer member 3. Therefore, when the outer member 3 is pushed onto the inner member 2 along its outer peripheral surface, the projecting portions 2E are elastically deformed to fix the outer member 3 to the inner member 2 with the communication path 9 formed therebetween.

The outer member 3 is, for example, made of a resin, more specifically, a thermoplastic resin such as polypropylene (PP) other than elastomers. Three rest portions 3D are formed at regular intervals in the circumferential direction along the inner peripheral edge of the bottom portion 3C of the outer member 3. When the rest portions 3D come into contact with the inner member 2, the communication path 8 is formed between the bottom portion 3C and the waterproof air-permeable membrane 10. Three engagement pieces 3E projecting inwardly are formed at regular intervals along the inner peripheral edge of an opening portion 3A of the side wall portion 3B of the outer member 3. The engagement pieces 3E are engaged with the edge portion of the inner member 2 and thus prevents detachment of the outer member 3 therefrom.

As described above, the air-permeable area of the waterproof air-permeable membrane as a waterproof air-permeable body is the area of a region (air-permeable region) of the waterproof air-permeable membrane through which a gas (air) can pass. The air-permeable area of the waterproof air-permeable membrane 10 in the vent member 1 is the area of the second opening portion 2D of the inner member 2 (i.e., the area defined by the inner diameter of the through hole 2A). In other words, the air-permeable area of the waterproof air-permeable membrane 10 is obtained by subtracting, from the area of the principal surface (through which a gas is introduced or released) of the waterproof air-permeable membrane 10, the area of a region of the waterproof air-permeable membrane 10 to which the inner member 2 is joined and through which air cannot pass in its cross-sectional direction (i.e., a direction perpendicular to the principal surface of the waterproof air-permeable membrane 10). The waterproof air-permeable membrane 10 may have an air-permeable region divided into two or more air-permeable sub-regions. In this case, the total area of these air-permeable sub-regions is treated as the air-permeable area.

The volume of air permeated per unit area of the waterproof air-permeable body such as the waterproof air-permeable membrane is not particularly limited, and it is preferably 0.010 to 500 $cm^3/cm^2/sec$, and particularly preferably 0.030 to 300 $cm^3/cm^2/sec$ in terms of a value measured by the Frazier method.

The air permeability value of the first vent member is preferably 0.5 to 220 $cm^3/sec$, and particularly preferably 0.5 to 133 $cm^3/sec$. The air permeability value of the second vent member is preferably 0.004 to 2.0 $cm^3/sec$, and particularly preferably 0.010 to 2.0 $cm^3/sec$. The total air permeability value of the first vent member and the second vent member is preferably 0.5 $cm^3/sec$ or more, more specifically 0.5 to 220 $cm^3/sec$, and more preferably 1.0 to 150 $cm^3/sec$. The total air permeability value is particularly preferably 2.0 to 120 $cm^3/sec$. As described above, the air permeability value of the vent member is determined by multiplying the volume of permeated air per unit area ($cm^3/cm^2/sec$) measured by the Frazier method by the air-permeable area ($cm^2$).

The first vent member and the second vent member may each be composed of two or more members. In this case, the total air permeability value of these members (vent sub-members) obtained by adding the air permeability values calculated for these members is regarded as the air permeability value of the first or second vent member. Thus, the first vent member and the second vent member each include at least one vent member (vent sub-member). Also in this case, the total air permeability value of the first vent sub-members of the first vent member is set higher than that of the second vent sub-members of the second vent member.

Referring back to FIG. 4A, the positions of the vent members disposed in the housing are described. The housing 102 may be provided with opening portions only in regions facing the first lamp chamber 110A and the second lamp chamber 110B (which means that the housing 102 has no other opening portion than the opening portions provided in the regions facing the first lamp chamber 110A and the second lamp chamber 110B) so that the vent members 105 and 106 are attached only to these opening portions.

EXAMPLES

Hereinafter, the present invention will be described in more detail by way of Examples. However, the present invention is not limited to Examples given below.

First, a test method for measuring the time required to eliminate condensation on the inner surface of the light-transmitting member is described.

Figure 2B:
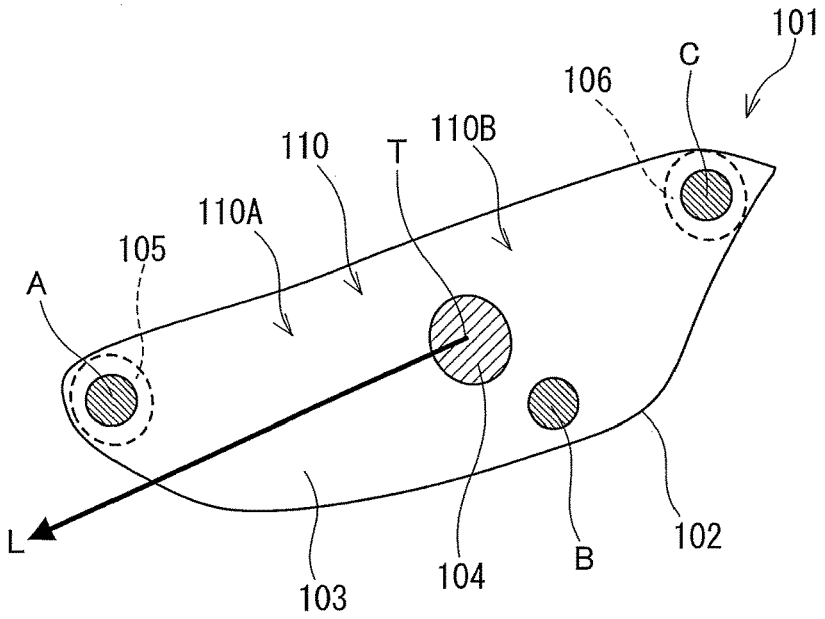
FIG. 2B is a schematic perspective view of the vehicle lamp shown in FIG. 1 in which thermo-hygrometers are placed.

The headlamp 101 having the shape shown in FIG. 1 and FIG. 2A was used for the test. In the lamp chamber 110 of the headlamp 101, a first thermo-hygrometer A, a second thermo-hygrometer B, and a third thermo-hygrometer C were placed at positions shown in FIG. 2B. The first thermo-hygrometer A and the third thermo-hygrometer C were disposed on the inner surface of the light-transmitting member 103 near the first opening portion 102B and the second opening portion 102C to which the first vent member 105 and the second vent member 106 were attached. Specifically, the thermos-hygrometers A and C were disposed near the front and rear corners of the inner surface of the light-transmitting member 103. The second thermo-hygrometer B was disposed between the first thermo-hygrometer A and the third thermo-hygrometer C, that is, in the central region of the inner surface of the light-transmitting member 103.

The forward illumination light source (bulb unit) 104 and a lamp socket connected thereto were pulled out of the headlamp 101 through its opening portion (not shown in the figure) so as to communicate the lamp chamber 110 with the space outside thereof through this opening portion.

Next, the headlamp 101 was placed in a constant temperature and humidity chamber (at a temperature of 40° C.

and a relative humidity of 0%) and left therein for two hours to dry the lamp chamber 110. Subsequently, the temperature and the relative humidity of the constant temperature and humidity chamber in which the headlamp 101 was placed were adjusted to 40° C. and 95% respectively, and then the headlamp 101 was further left therein for two hours to introduce humid air into the lamp chamber 110. After the lapse of two hours, the bulb unit and the lamp socket were attached to the above-mentioned opening portion of the headlamp 101 in the constant temperature and humidity chamber so as to close the opening portion.

Next, the headlamp 101 was removed from the constant temperature and humidity chamber and set in a water spray tester. Then, the water spray tester was activated to spray 10° C. pure water over the headlamp 101 for 30 seconds. During the water spray, condensation occurred on the inner surface of the light-transmitting member 103.

The water spray was stopped and then the forward illumination light source 104 as a low beam light source was turned on. In this state, the temperature and humidity in the lamp chamber 110 were measured with the first thermo-hygrometer A, the second thermo-hygrometer B, and the third thermo-hygrometer C, and the time required to eliminate condensation on the inner surface of the light-transmitting member 103 after the forward illumination light source 104 was turned on. Whether or not condensation was eliminated was determined by visual inspection from outside the light-transmitting member 103. The amount of water vapor was calculated based on the measured temperature and humidity.

In the present embodiment, the case where a waterproof air-permeable membrane was used as a waterproof air-permeable body is described, but the waterproof air-permeable body may be a porous resin molded body. A preferred example of such a porous resin molded body is a porous molded body made of a polybutylene terephthalate (PBT) resin.

Examples 1 to 2 and Comparative Examples 1 to 3

As the first vent member 105 and the second vent member 106, CAPSEAL vent members (manufactured by Nitto Denko Corporation) having air permeability values shown in Table 1 were used. The structure of the CAPSEAL vent members was the same as shown in FIG. 6 and FIG. 7. Stretched porous PTFE membranes were used as waterproof air-permeable membranes in both of these vent members. The lengths of time required to eliminate condensation were as shown in Table 1.

TABLE 1

| | Air permeability value of first vent member [$cm^3$/sec] | Air permeability value of second vent member [$cm^3$/sec] | Time required to eliminate condensation [min] |
|---|---|---|---|
| Example 1 | 11 | 0.11 | 60 |
| Example 2 | 110 | 0.11 | 20 |
| Com. Example 1 | 0.11 | 0.11 | 180 |
| Com. Example 2 | 0.11 | 110 | 120 |
| Com. Example 3 | 110 | 110 | 80 |

Figure 5:
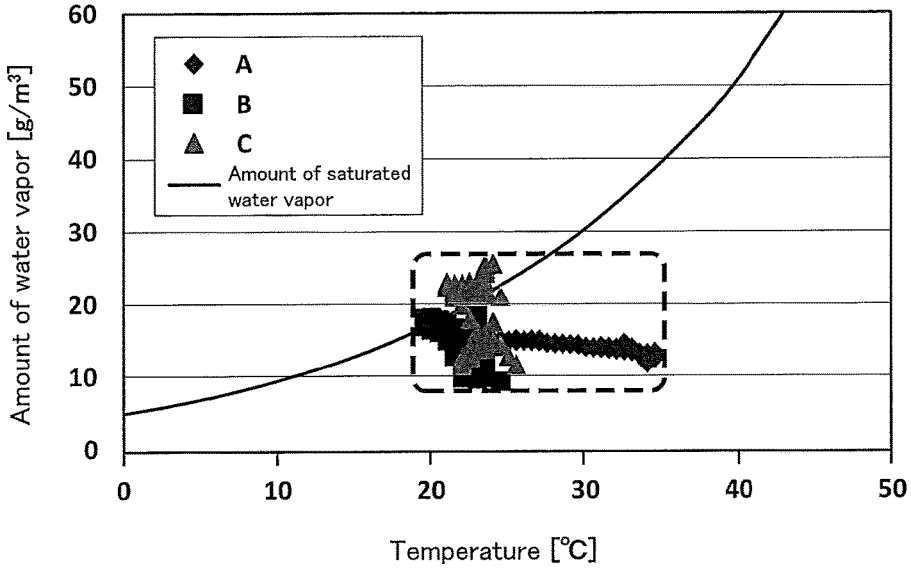
FIG. 5 is a graph showing the relationship between the temperature and the amount of water vapor in Comparative Example 2.

FIG. 5 shows the relationship between the temperature measured and the amount of water vapor in Comparative Example 2. In Comparative Example 2, as shown in FIG. 5, at the position where the third thermo-hygrometer C was placed, the amount of water vapor increased with time, and a series of triangles (Δ) depicted in FIG. 5 were kept above the saturated water vapor curve for a long time. On the other hand, at the position where the first thermo-hygrometer A was placed, the temperature increased with time. This is probably attributed to the fact that water vapor produced in the front part 103A of the light-transmitting member 103 flowed rearward and accumulated near the rear part 103B to an amount far exceeding the amount of saturated water vapor.

Also in Comparative Examples 1 and 3, there was a phenomenon in which the amount of water vapor increased with time and exceeded the amount of saturated water vapor at the position where the third thermo-hygrometer C was placed, although not shown in the figure. In Comparative Example 1, the amount of water vapor temporarily exceeded the amount of saturated water vapor at all the positions where the first to third thermo-hygrometers A to C were placed. In Comparative Example 3, however, an increase in the amount of water vapor at the position where the third thermo-hygrometer C was placed was smaller than that in Comparative Examples 1 and 2, which means that the amount of water vapor only slightly exceeded the amount of saturated water vapor. In contrast, in Examples 1 and 2, the amount of water vapor did not exceed the amount of saturated water vapor at the position where the third thermo-hygrometer C was placed.

INDUSTRIAL APPLICABILITY

The vehicle lamp according to the present invention is useful as a lamp, such as a headlamp or a fog lamp, to be mounted in a front end portion of a vehicle.

The invention claimed is:

1. A vehicle lamp adapted to be mounted at a lateral end of a front end portion of a vehicle, comprising:

a housing;

a light-transmitting member attached to the housing so as to form a lamp chamber;

a forward illumination light source disposed in the lamp chamber and configured to emit light in a forward direction of the vehicle through the light-transmitting member; and a first vent member and a second vent member, wherein the lamp chamber comprises a first lamp chamber and a second lamp chamber, the first lamp chamber being located in the forward direction of the vehicle from a first reference plane and inwardly of a second reference plane in a width direction of the vehicle and the second lamp chamber being located in a rearward direction of the vehicle from the first reference plane and outwardly of the second reference plane in the width direction of the vehicle, when a plane perpendicular to an optical axis of the forward illumination light source and passing a forward end of the forward illumination light source is defined as the first reference plane and a plane including the optical axis and extending in a vertical direction is defined as the second reference plane, the light-transmitting member comprises a front part and a rear part, the front part being located in the forward direction from the first reference plane and facing the first lamp chamber, the rear part being located in the rearward direction from the first reference plane and facing the second lamp chamber, the first vent member is attached to a first opening portion provided in a region of the housing facing the first lamp chamber, the second vent member is attached to a second opening portion provided in a region of the housing facing the second lamp chamber, the first vent member and the second vent member each comprise a porous resin membrane, and an air permeability value of the first vent member is higher than an air permeability value of the second vent member when the air permeability value of each of the first and second vent members is determined by measuring a volume of air permeated per unit area of the porous resin membrane and multiplying the measured volume of air by an air-permeable area of the porous resin membrane.

2. The vehicle lamp according to claim 1, wherein the air permeability value of the first vent member is at least twice the air permeability value of the second vent member.

3. The vehicle lamp according to claim 2, wherein the air permeability value of the first vent member is at least ten times the air permeability value of the second vent member.

4. The vehicle lamp according to claim 1, wherein a total air permeability value of the first vent member and the second vent member is 0.5 to 220 $cm^3$/sec.

* * * * *